US006402184B1

(12) United States Patent
Hauglin

(10) Patent No.: US 6,402,184 B1
(45) Date of Patent: Jun. 11, 2002

(54) BINDING FOR CROSS-COUNTRY OR TRAIL SKIS

(75) Inventor: Bernt-Otto Hauglin, Røyken (NO)

(73) Assignee: Rottefella AS, Kokkarstua (NO)

( * ) Notice: Subject to any disclaimer, the term of this patent is extended or adjusted under 35 U.S.C. 154(b) by 0 days.

(21) Appl. No.: 09/623,693

(22) PCT Filed: Dec. 28, 1998

(86) PCT No.: PCT/IB98/02124

§ 371 (c)(1),
(2), (4) Date: Sep. 1, 2000

(87) PCT Pub. No.: WO99/44700

PCT Pub. Date: Sep. 10, 1999

(30) Foreign Application Priority Data

Mar. 6, 1998 (DE) ..... 198 09 729

(51) Int. Cl.[7] ..... A63C 9/00
(52) U.S. Cl. ..... 280/615; 280/631; 280/636
(58) Field of Search ..... 280/615, 614, 280/604, 605, 631, 632, 626, 636

(56) References Cited

U.S. PATENT DOCUMENTS

| | | | | |
|---|---|---|---|---|
| 4,235,452 A | * | 11/1980 | Linecker | 280/615 |
| 4,533,154 A | * | 8/1985 | Bernard et al. | 280/615 |
| 4,691,936 A | * | 9/1987 | Nowak et al. | 280/615 |
| 5,048,855 A | * | 9/1991 | Girault et al. | 280/615 |
| 5,125,680 A | * | 6/1992 | Bejean et al. | 280/615 |
| 5,190,310 A | | 3/1993 | Haughlin et al. | |
| 6,318,558 B1 | * | 11/2001 | Lichtenwalner | |

FOREIGN PATENT DOCUMENTS

| | | | |
|---|---|---|---|
| DE | 3142623 | * | 5/1983 |
| DE | 33 20 559 A1 | | 12/1983 |
| DE | 36 33 098 C2 | | 11/1988 |
| EP | 0 163 054 A1 | | 12/1985 |
| EP | 183000 | * | 6/1986 |
| EP | 254094 | * | 1/1988 |
| EP | 359964 | * | 3/1990 |
| EP | 0 768 103 A1 | | 4/1997 |
| FR | 2 537 010 | | 6/1984 |
| FR | 2582226 | * | 11/1986 |
| FR | 2590491 | * | 5/1987 |
| WO | WO 90/11806 | | 10/1990 |

* cited by examiner

*Primary Examiner*—Brian L. Johnson
*Assistant Examiner*—Bryan Frischmann
(74) *Attorney, Agent, or Firm*—Knobbe, Martens, Olson & Bear, LLP

(57) ABSTRACT

Cross-country or touring ski binding (17) with a mechanism (10) for coupling an associated boot (11) so that it is rotatable about an axis (13) in the front region of the boot extending approximately parallel to the sole tread (12) and approximately transverse to the long direction of sole and ski, and with a device (14) for the elastic restoration of the position of the boot (11), from a tilted-up position into a position approximately parallel to the ski, wherein an additional elastically deformable element (15) is provided that counteracts the device (14) for elastic restoration of the boot (11), in particular at the beginning of the upward tilting of the boot (11).

10 Claims, 4 Drawing Sheets

BINDING FOR CROSS-COUNTRY OR TRAIL SKIS

FIELD OF THE INVENTION

The invention relates to a cross-country or touring ski binding with a mechanism for attaching an associated boot so that the boot can be swivelled about an axis in its front region that extends approximately parallel to the boot sole and approximately perpendicular to the long direction of the sole and ski, and with a device for elastically returning the boot from a tilted-upward position into a position approximately parallel to the ski.

BACKGROUND OF THE INVENTION

Cross-country or touring ski bindings of this kind are generally known, for example from European Patent No. 424 479 and U.S. Pat. No. 5,190,310. This sort of cross-country or touring ski binding is characterized by an elastic restoring element or so-called "flexor," which is disposed between the front end of the ski-boot sole, in particular the front edge of the sole, and a binding case. Then lifting of the heel of the boot is opposed by the elastic action of the said flexor.

Another kind of cross-country or touring ski binding is characterized in that the elastic restoring element has the form of an elastic traction element that acts behind the swivelling axis of the boot, in the ball region of the sole, and tends to pull the boot back into a position parallel to the ski when the heel is raised. The pulling action of this element can be brought about by the force exerted by either an extension spring or a compression spring. A construction of this kind is described, for example, in European Patent No. 768 103.

Both kinds of bindings are thus characterized by only one elastic restoring element or a single flexor, against the action of which the heel of the boot can be raised. A disadvantage of this basic principle of construction is that at the beginning of the process of raising the heel it is only slightly effective if at all, with the consequence that the front part of the ski, in particular the upwardly curved tip (the shovel), stays on the ground so that it is not yet possible to initiate a change of direction with the ski. The danger of falling over the ski shovel would be too great. This disadvantage becomes particularly noticeable during racing.

SUMMARY OF THE INVENTION

The object of the present invention is thus to create a binding system that can be counterbalanced in such a way that when the boot is raised and hence its heel swung up, this movement is initially reinforced, so that the ski with its shovel is separated from the ground, with the result that the ski can be used to initiate a change of direction with no danger of falling.

This object is achieved in accordance with the invention by an additional elastically deformable element that counteracts the operation of the device for elastic restoration of the boot's position, in particular when the boot is first being tilted up. That is, two elastic restoring elements are acting on the boot, one of which promotes tilting upwards while the other counteracts such tilting. Accordingly, the elastic restoring elements act on the two sides of the boot's axis of rotation, in opposite directions. The strength of the elastic restoring force can be made different in different elements. Preferably it can be varied by adjustment. To permit variation the elastic restoring elements can be so constructed as to be exchangeable by simple means. In principle a construction is also conceivable that would allow the hardness of the elastic restoring elements to be continuously finely adjustable, for instance by integration of a helical compression spring, the tension of which can be made more or less strong by turning an adjustment screw.

Many cross-country or touring ski bindings are characterized in that the mechanism by which the boot is coupled at the front part of the sole, in particular at its front end, to engagement elements of the binding comprises insertable, complementary engagement elements to produce a joint-like connection, such that the sole-sided engagement elements consist of an axle oriented transverse to the long direction of the ski and about parallel to the sole, and the complementary engagement elements on the binding side comprise a retaining element that extends over or under the joint axle so as to form therewith a swivel bearing or hinge joint, and that can be moved out of a closed position into a release position by means of a handle disposed on the binding, in particular an actuating lever. In addition there is provided either an elastically deformable pressure element or flexor that acts between the boot and the binding or the ski in the region in front of the joint axle, in particular at the front end of the sole, or an elastically deformable traction element that acts between the boot and the binding or the ski in the region behind the joint axis, in particular the ball region of the sole, the action in either case tending to move the boot back towards the ski when its heel has been raised from the upper surface of the ski. In order to counteract the elastically deformable restoring element or flexor in such a binding, in accordance with the invention there is provided a separate elastically deformable element, either in the form of an elastically deformable pressure element or flexor disposed behind the joint axle, i.e. in the ball region of the front sole of the boot, or in the form of an elastically deformable traction element attached ahead of the joint axle.

The restoring force of the elastically deformable restoring element or flexor ordinarily increases progressively as the boot heel is raised. Preferably the force exerted by the element provided to elastically counteract this restoring element decreases uniformly. This means that the element counteracting the elastic restoring element or flexor initially acts more strongly, as a result of which the effect cited above is particularly well achieved.

The principle in accordance with the invention can also be applied in the case of a binding such that the boot is held on a boot-holding element mounted so that it can swing about an axis that extends approximately parallel to the tread of the sole and approximately transverse to the long direction of the ski, in particular on a pivotably mounted plate. In this case the element that counteracts the elastic restoring force exerted on the boot acts on the pivotably mounted boot-holding element or the pivotably mounted plate.

BRIEF DESCRIPTION OF THE DRAWINGS

In the following two embodiments of cross-country or touring ski bindings in accordance with the invention are explained with reference to the attached drawings, wherein.

DETAILED DESCRIPTION OF THE INVENTION

Figure 1:
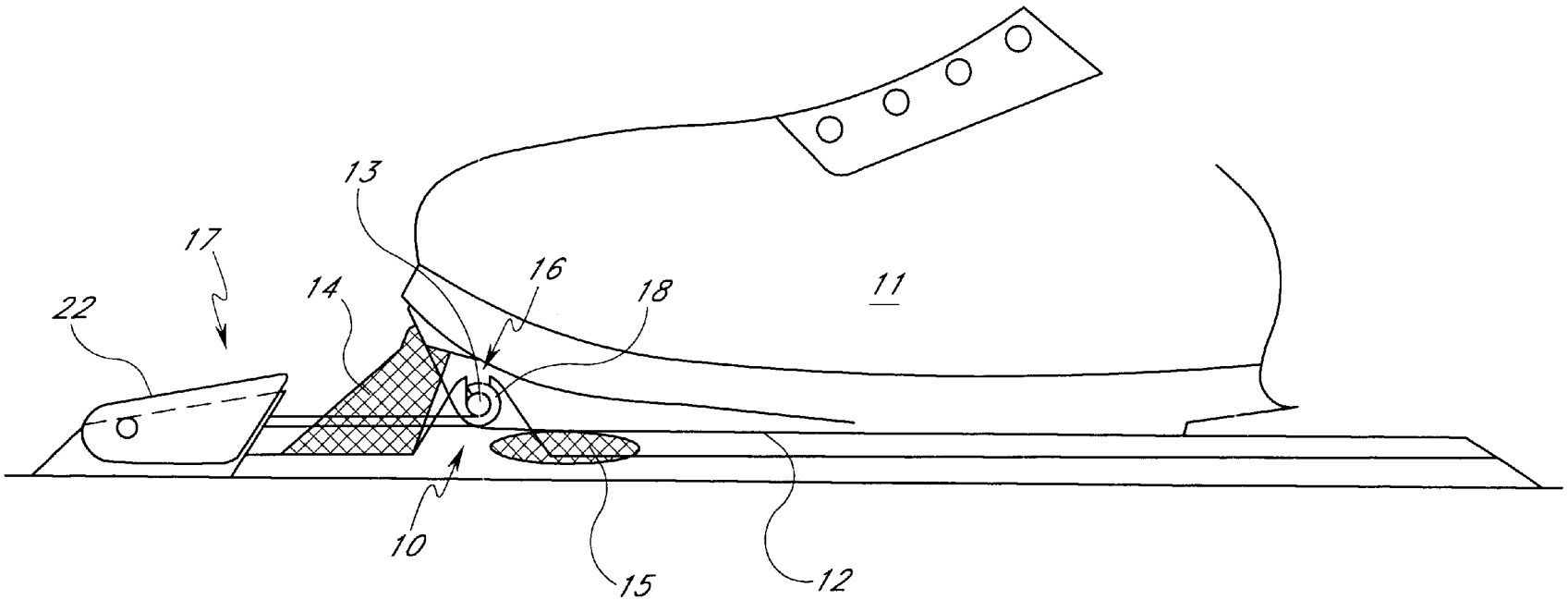
FIG. 1 and FIG. 2 show a first embodiment of a cross-country or touring ski binding in accordance with the invention in schematic side view, such that in FIG. 1 the boot is in a position parallel to the ski and in FIG. 2 it is tilted upwards.
Figure 2:
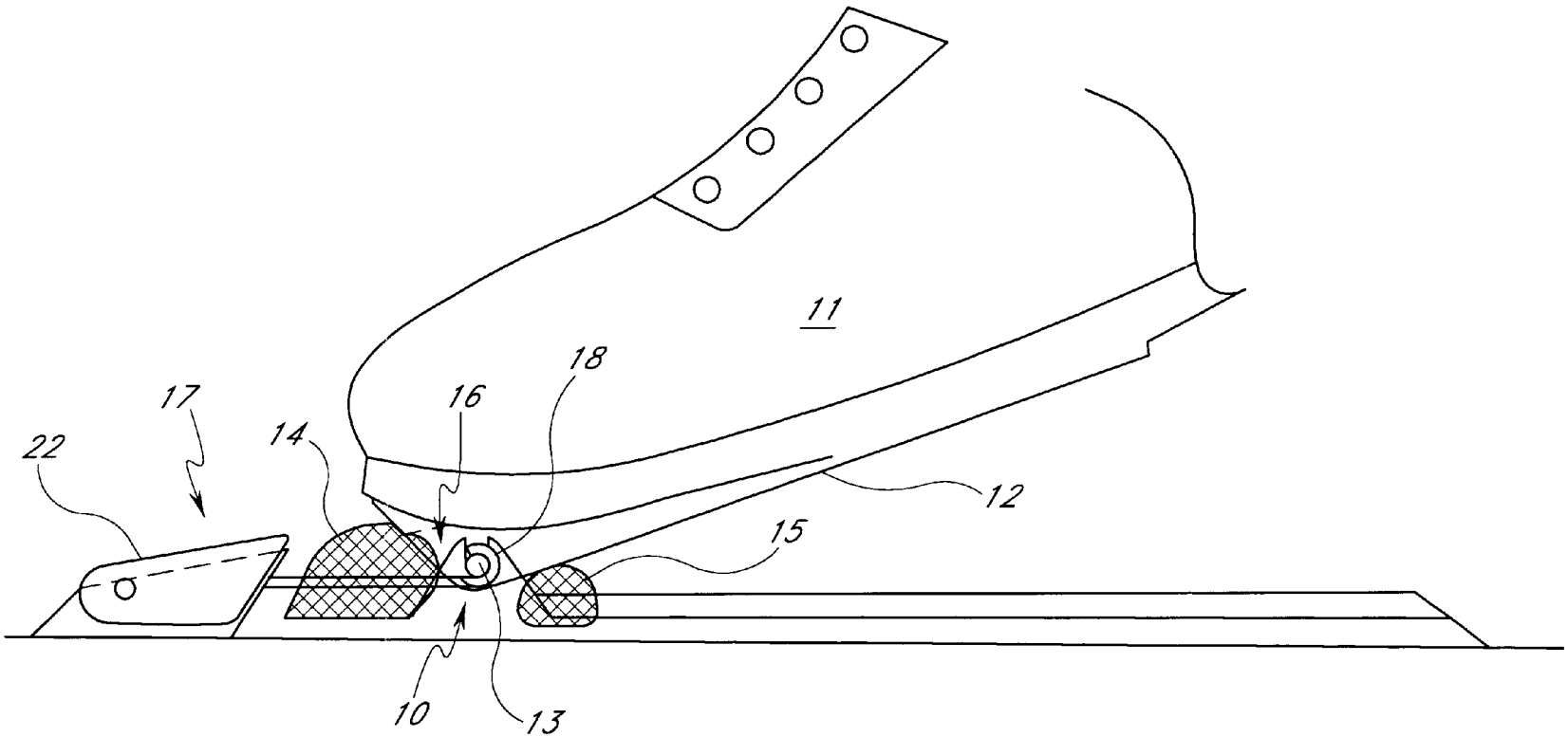

The cross-country or touring ski binding shown schematically in FIGS. 1 and 2 comprises a mechanism 10 by which an associated boot 11 can be coupled to an axle 13 in the front region of the boot that extends approximately parallel to the boot sole 12 and approximately transverse to the long direction of boot sole and ski, as well as a device 14 for the elastic restoration of the boot 11 from an upwards-tilted position as shown in FIG. 2 into a position approximately parallel to the ski a s shown in FIG. 1. Hereinafter, the device 14 is referred to as "elastically deformable element 14." Specifically, the mechanism 10 for coupling of the boot 11 comprises, disposed on the front part of the sole 12 and here at its front end 16, engagement elements that are complementary to engagement elements on the binding 17 and can be inserted thereinto in order to produce a joint-like connection, such that the engagement elements on the sole 12 consist of a joint axle 13 that extends transverse to the long direction of the ski and approximately parallel to the sole, and the complementary engagement elements of the binding 17 consist of a holding element 18 that extends under and around the joint axle 13 ad forms therewith a swivel bearing or hinge joint 10. This joint can be moved by means of a handle 22 disposed on the binding 17, in particular an actuating lever, out of a closed position corresponding to FIGS. 1 and 2 into a release position. Between the front end 16 of the sole and the case of the binding 17 the elastically deformable element 14 (flexor) acts to restore the boot 11 to its original position when the heel of the boot is raised away from the upper surface of the ski as shown in FIG. 2. In FIG. 2 the elastic deformation of the elastically deformable element 14, which acts as an elastically deformable pressure element, can be seen.

This elastically deformable element 14 is counteracted by a separate, likewise elastically deformable element 15, which is disposed behind the joint axle 13, specifically in the ball region of the front part of the boot sole, and is constructed as an elastically deformable pressure element. The elastically deformable element 15 thus acts in opposition to the elastically deformable element 14. In this way the two elastically deformable elements 14 and 15 bring about a kind of balance about the axis of rotation 13 between boot 11 and ski. Preferably the elastically deformable elements, i.e. the elastically deformable element 14 on one hand and the counteracting elastically deformable element 15 on the other hand, are made differently hard. In the embodiment according to FIGS. 3 and 4, the elastically deformable element 14 comprises an additional spring element in the form of a helical compression spring 19. This is incorporated into the elastically deformable element 14 in such a way that its long axis extends in the main direction of action during raising of the boot sole, i.e. it is slanted towards the front end of the sole.

The elastically deformable elements 14, 15 are each moulded rubber parts exchangeably installed within the binding case.

In a preferred embodiment, the restoring force of the elastically deformable element 14 increases progressively as the boot heel is raised, whereas the oppositely directed force of the elastically deformable element 15, which counteracts this elastically deformable element 14, decreases to the same degree. However, as mentioned above, the balance between the two elastically deformable elements 14, 15 can be adjusted by altering the hardness of the two elements, depending both on the conditions of use of the binding and on the user and the skiing technique employed.

Figure 3:
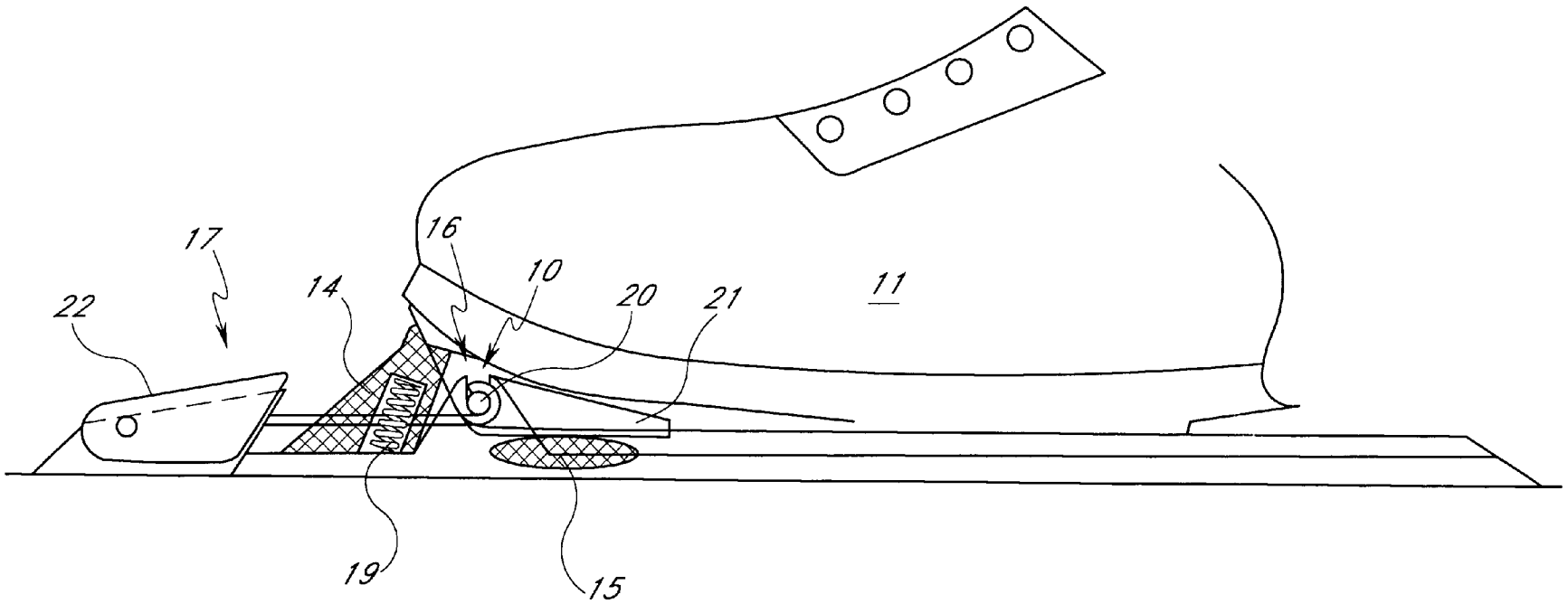
FIGS. 3 and 4 show a second embodiment of a cross-country or touring ski binding in accordance with the invention in schematic side view, such that in FIG. 3 the boot is in a position parallel to the ski and in FIG. 4 it is tilted upwards.
Figure 4:
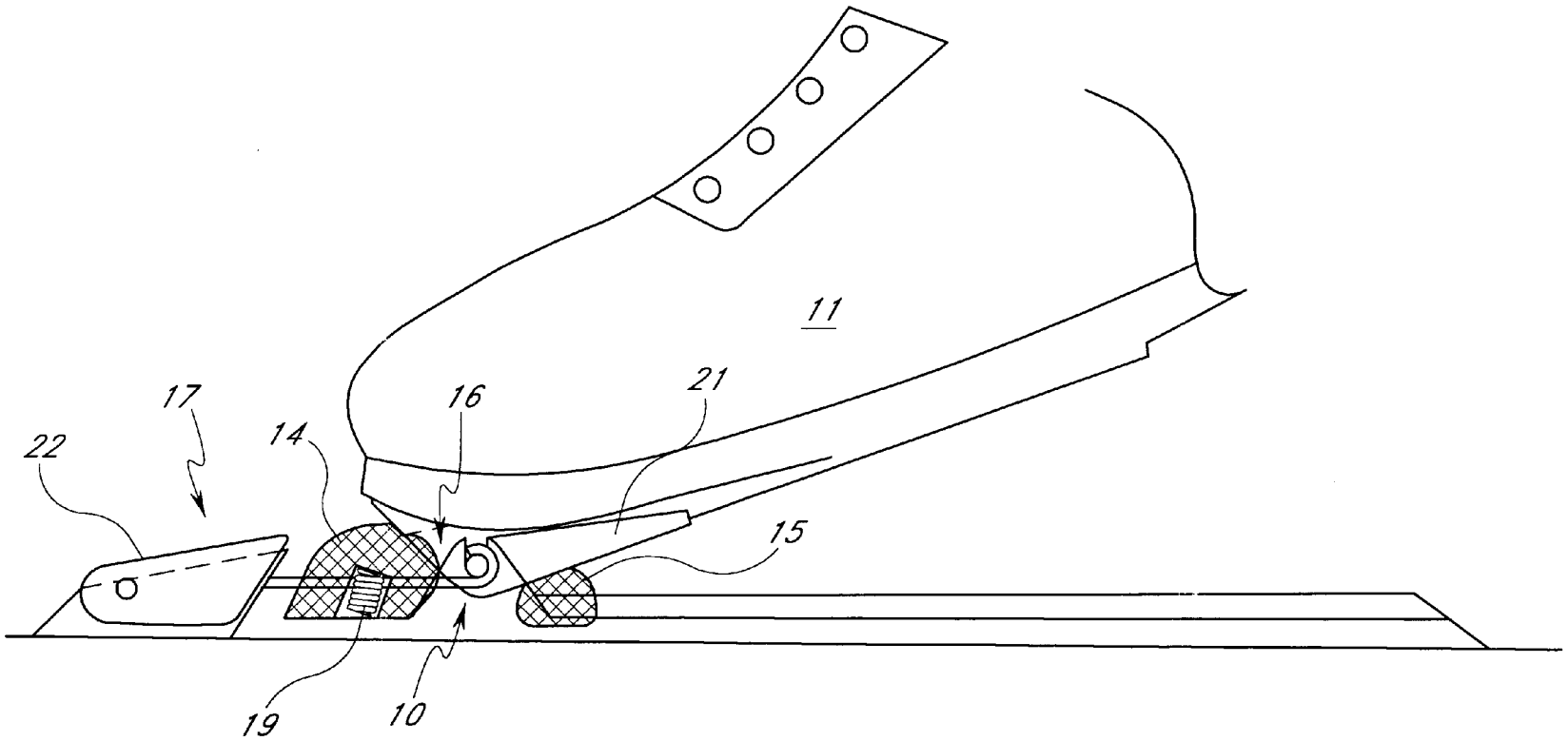

The embodiment according to FIGS. 3 and 4 differs from that according to FIGS. 1 and 2 primarily in that the boot 11 is held on a sole-holding plate 21, which is so mounted that it can be swung about an axle 20 that extends approximately parallel to the sole 12 and approximately perpendicular to the long direction of the ski, such that the elastically deformable element 15, which counteracts the elastic restoration of the boot 11, acts between the holding plate 21 and the binding case or ski, as is clearly shown in FIGS. 3 and 4.

It should also be pointed out that it is in principle conceivable for the elastically deformable element to take the form of an elastically deformable traction element positioned between the region of the sole behind the joint axle 13, in particular the ball region, and the binding or the ski. This traction element then has the same function as the elastically deformable element 14 in FIGS. 1 to 4.

It is further conceivable that the elastically deformable element 15, which counteracts the restoring element, could be constructed as an elastically deformable traction element attached ahead of the joint axle 13. The crucial consideration is that two elastically deformable elements are so disposed as to counteract one another and are so dimensioned that a predetermined balance is achieved for the boot 11 with respect to the ski.

All characteristics disclosed in the application documents are claimed as essential to the invention insofar as they are new to the state of the art, singly or in combination.

LIST OF REFERENCE NUMERALS

10 Coupling mechanism (hinge joint)
11 Boot
12 Boot sole
13 Swivelling axle
14 Elastically deformable element
15 Elastically deformable element
16 Front end of sole
17 Binding
18 Holding element
19 Helical compression spring
20 Swivelling axle
21 Holding or sole plate

What is claimed is:

1. A cross-country or touring ski binding, comprising a mechanism for coupling an associated boot to a ski so that the boot is rotatable about an axis intersecting a front region of the boot and extending approximately parallel to a sole and approximately transverse to a long direction of the sole and the ski;

a first elastically deformable element to elastically restore a position of the boot, from a tilted-up position into a position approximately parallel to the ski; and a second elastically deformable element, which counteracts the first elastically deformable element such that the first elastically deformable element, and the second elastically deformable element are disposed under a front section of a front part of the sole of the boot in such a way that the boot is elastically braced at the front section of the front part of the sole ahead of and behind the axis.

2. The binding of claim 1, wherein the mechanism for coupling the boot in the front part of the sole comprises first engagement elements that are complementary to and can be inserted into second engagement elements on the binding in order to produce a joint, wherein the first engagement elements have a joint axle that extends transverse to the long direction of the sole and the ski and approximately parallel to the sole, and the complementary second engagement elements of the binding have a holding element that is configured to form a swivel bearing or a hinge joint, and that can be moved by means of a handle disposed on the binding out of a closed position into a release position; and wherein the first elastically deformable element is an elastically deformable pressure element positioned between the region ahead of the joint axle and the binding or the ski, and the second elastically deformable element is an elastically deformable traction element positioned between the region behind the joint axle and the binding or the ski, either of which elements acts to restore the position of the boot when the heel of the boot is lifted up from an upper surface of the ski.

3. The binding of claim 1, wherein the first elastically deformable element is configured to have a first stiffness, wherein the second elastically deformable element is configured to have a second stiffness, and wherein the first stiffness is different from the second stiffness.

4. The binding of claim 3, wherein the first elastically deformable element can be adjusted to different degrees of stiffness.

5. The binding of claim 1, wherein a restoring force of the first elastically deformable element increases progressively as the heel of the boot is raised, whereas a positioning force of the second elastically deformable element decreases to the same degree.

6. The binding of claim 1, wherein the boot is held on a boot-holding element so mounted that it can be swung about an axle that extends approximately parallel to the sole and approximately transverse to the long direction of the ski such that the second elastically deformable element acts on a pivotably mounted boot-holding element or on a pivotably mounted plate.

7. The binding of claim 2, wherein the holding element is configured to project over, under or around the joint axle to form the swivel bearing or the hinge joint.

8. The binding of claim 2, wherein the handle is configured as an actuating lever.

9. The binding of claim 2, wherein the first elastically deformable element is postionable between the front end of the sole and the binding or the ski, and the second elastically deformable element is positionable between a ball region of the sole and the binding or the ski.

10. The binding of claim 1, wherein the boot is held on a pivotably mounted plate so mounted that it can be swung about an axle that extends approximately parallel to the sole and approximately transverse to the long direction of the ski such that the second elastically deformable element acts on the pivotably mounted plate.

* * * * *